US008365542B2

(12) United States Patent
Shah

(10) Patent No.: US 8,365,542 B2
(45) Date of Patent: Feb. 5, 2013

(54) FROST FREE SUB ZERO AIR CONDITIONER

(76) Inventor: Surendra Himatlal Shah, Mumbai (IN)

( * ) Notice: Subject to any disclaimer, the term of this patent is extended or adjusted under 35 U.S.C. 154(b) by 4 days.

(21) Appl. No.: 13/060,080

(22) PCT Filed: Mar. 15, 2010

(86) PCT No.: PCT/IN2010/000151

§ 371 (c)(1),
(2), (4) Date: Mar. 29, 2011

(87) PCT Pub. No.: WO2010/131257

PCT Pub. Date: Nov. 18, 2010

(65) Prior Publication Data

US 2011/0289956 A1 Dec. 1, 2011

(30) Foreign Application Priority Data

Mar. 15, 2009 (IN) ..... 2615/MUM/2008

(51) Int. Cl.
*F25B 7/00* (2006.01)

(52) U.S. Cl. ..... 62/151; 62/80; 62/81; 62/89; 62/90; 62/117; 62/150; 62/173; 62/175; 62/186; 62/198; 62/199; 62/259.1; 62/277; 62/335; 62/526; 236/49.3; 236/1 EA; 165/217; 165/228; 165/230; 165/231; 165/261

(58) Field of Classification Search ..... 62/80, 81, 62/89, 90, 117, 150, 173, 175, 186, 198, 62/199, 259.1, 277, 335, 524, 526; 236/49.3, 236/1 EA; 165/217, 228, 230, 231, 261
See application file for complete search history.

(56) References Cited

U.S. PATENT DOCUMENTS

| | | | | | |
|---|---|---|---|---|---|
| 2,522,484 | A | * | 9/1950 | Ringquist et al. | 62/90 |
| 3,203,196 | A | * | 8/1965 | Malkoff | 62/173 |
| 3,402,564 | A | * | 9/1968 | Nussbaum | 62/173 |
| 3,529,659 | A | * | 9/1970 | Trask | 165/231 |
| 3,978,684 | A | * | 9/1976 | Taylor | 62/324.3 |
| 4,270,362 | A | * | 6/1981 | Lancia et al. | 62/173 |
| 4,271,678 | A | * | 6/1981 | Liebert | 62/173 |
| 4,332,137 | A | * | 6/1982 | Hayes, Jr. | 62/81 |
| 4,353,409 | A | * | 10/1982 | Saunders et al. | 165/240 |

(Continued)

*Primary Examiner* — Frantz F. Jules
*Assistant Examiner* — Azim Abdur Rahim

(57) ABSTRACT

The present invention provides an energy efficient air conditioner that can provide a continuous supply of air at dew point that is several degrees Celsius below zero, without requiring a defrost cycle. The air conditioner in accordance to present invention comprises a plurality of cooling coils with interconnecting refrigerant piping, refrigeration circuit consisting of compressor and condenser coils, control circuit and one or more electric motor driven centrifugal fan. The present invention uses two cooling systems. The first cooling system having single coil cools the air to a temperature just above zero deg. C., say four deg. C. so that the second stage gets a steady supply of cold air. The second stage has two coils, each being half the size of the first stage coil, thus taking half the air from it so that all the air from stage 1 passes through stage 2. In operation, only one coil of the second stage is active arid chills the air going through it to say minus 14 Deg. C. The other coil, being inactive, passes on the +4 Deg. C. air coming from the first stage. In order to prevent the active coil from icing up, a control circuit diverts the refrigerant to the second coil within a period short enough to prevent any significant ice build up in that coil. This goes on so that the total air flow is a steady 50% mixture of air at 4 Deg. C. and minus 14 deg. C. This works out to minus 5 Deg. C. at the output.

16 Claims, 5 Drawing Sheets

U.S. PATENT DOCUMENTS 4,578,959 A * 4/1986 Alsenz ..... 62/140
5,337,577 A * 8/1994 Eiermann ..... 62/173
5,400,607 A * 3/1995 Cayce ..... 62/90
5,651,258 A * 7/1997 Harris ..... 62/90
5,953,926 A * 9/1999 Dressler et al. ..... 62/175
7,165,414 B2 * 1/2007 Wright ..... 62/277

* cited by examiner

REFRIGERATION CIRCUIT DIAGRAM

A FROST FREE SUB-ZERO AIR CONDITIONER

FROST FREE SUB ZERO AIR CONDITIONER

FIELD OF THE INVENTION

The present invention relates to the air conditioning system. More particularly it relates to an air conditioner which can provide a continuous supply of air at dew point that is several degrees Celsius below zero without requiring a defrost cycle.

PRIOR ART

In air conditioners when moist air is cooled to a temperature below the dew point, the moisture in it condenses as water. If this dew point is below zero, the condensed water turns into ice. Since most air conditioners and dehumidifiers cools air by passing it through a finned coil, this ice very soon get accumulated between the fins and block the passage of air through the coil. It becomes than necessary to de-frost the coil. The coil is de-frosted by way of heating and heating can be done either by any of the following alternatives:

a. Heating by hot compressor gas b. Heating by hot water or c. Heating by electricity.

This process raises the temperature of the air being above zero, thus keeping it off design for the duration of the cycle. It also increases the energy consumption due to heating with external energy. Addition of external heat also requires a larger cooling unit, which consumes more energy. Due to aforementioned factors the overall air conditioning system becomes costly.

Another way to provide sub-zero air temperature is chemical de-humidification unit. But it also consume very high amount of energy and thereby leading to increase in the cost of the air conditioner system.

Therefore it is necessary to provide a new air conditioner which will be free from all the above mentioned problems.

OBJECT OF THE INVENTION

The primary object of the present invention is to provide an air conditioner which will overcome all the abovementioned problems associated with the prior art air conditioners.

Another object of the present invention is to provide a frost free sub-zero air conditioner.

Yet another object of the present invention is to provide a frost free sub-zero air conditioner which provides a continuous precision source of air cooled to a dew point that is set below zero degrees Celsius by way of refrigeration only.

Yet another object of the present invention is to provide a frost free sub-zero air conditioner which is cheaper than the prior art air conditioner.

Yet another object of the present invention is to provide a frost free sub-zero air conditioner which requires less maintenance cost.

Yet another object of the present invention is to provide a frost free sub-zero air conditioner which consumes comparatively less electricity for its operation.

Yet another object of the present invention is to provide a frost free sub-zero air conditioner which is reliable in operation.

STATEMENT OF THE INVENTION

Accordingly to achieve aforesaid objects, present invention provides an energy efficient frost free sub zero air conditioner comprising:

plurality of precooling coils for receiving the air to be conditioned and passing said air towards cooling system;

at least single pair of cooling system for providing continuous supply of air at dew point that is several degrees Celsius below zero, each of said pair of cooling system comprises:

first cooling system comprising at least one, cooling coil to cool air at first temperature that is just above zero degree Celsius;

second cooling system comprising cooling coils more in number than that of cooling coils of first cooling system, said cooling coils placed side by side, in same plane, such that their combined dimensions equal to that of cooling coil of the first cooling system, said second cooling system cool air at second temperature that is below zero degree Celsius;

at least one electric motor driven fan for delivering required air from said second cooling system into area to be conditioned;

at least one refrigeration circuit comprising at least one compressor having condenser coil, said refrigeration circuit further comprises an electric motor driven fan for cooling said condenser coil;

plurality of heat recovery coils to recover heat from precooling coils;

plurality of reheating coils for providing reheating of the cooled air to prevent the defrost cycle in air conditioner;

plurality of connecting pipes for defining path of the refrigerant being used to cool the air to be conditioned and for connecting said cooling coils, condenser coils, heat recovery coils and reheating coils as per interconnection design of said air conditioner;

a control circuit for controlling the flow of refrigerant through the coils of the second cooling system to prevent ice formation in said coils;

wherein the said air at first temperature from first cooling system is provided in certain proportion to each of the cooling coils of the second cooling system and wherein as per requirement said control circuit keeps some of the cooling coils of second cooling system in active mode by allowing flow of refrigerant through said coils while keeping remaining cooling coils of second cooling system in inactive mode by disallowing flow of refrigerant through said coils so that the total air, flow from the second cooling system is steady 50% mixture of air at first temperature and air at second temperature.

BRIEF DESCRIPTION OF THE DRAWINGS

Figure 1:
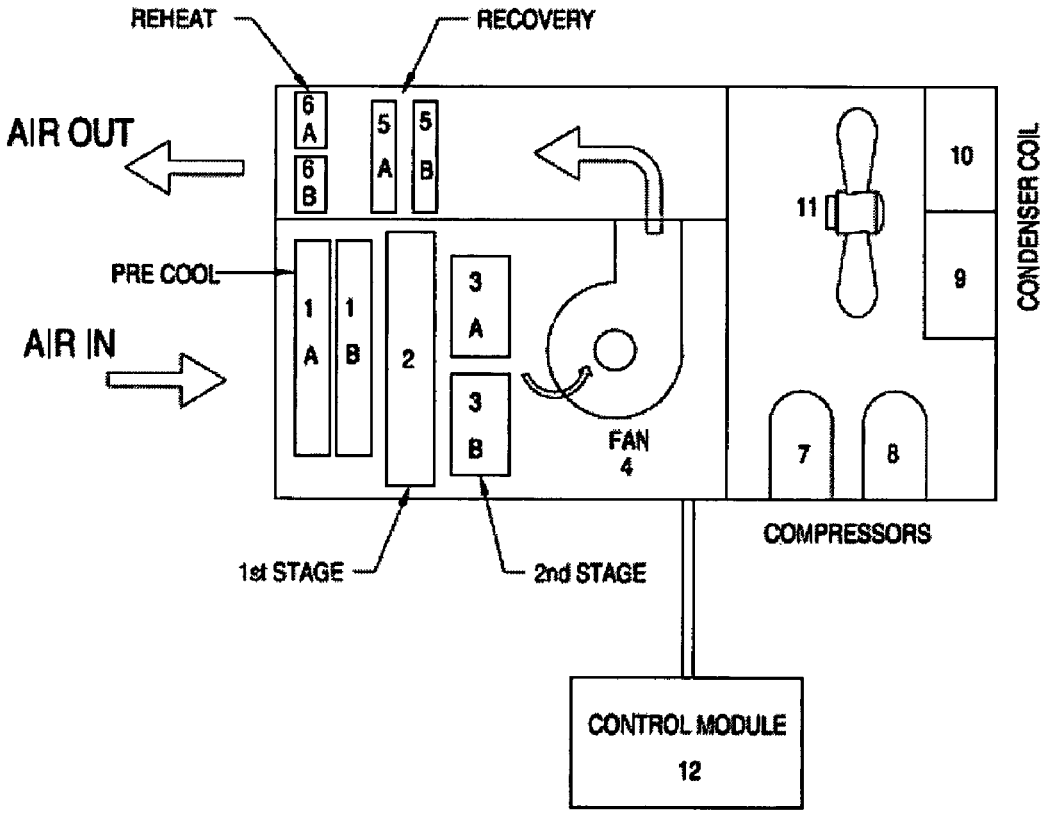
Figure 2A:
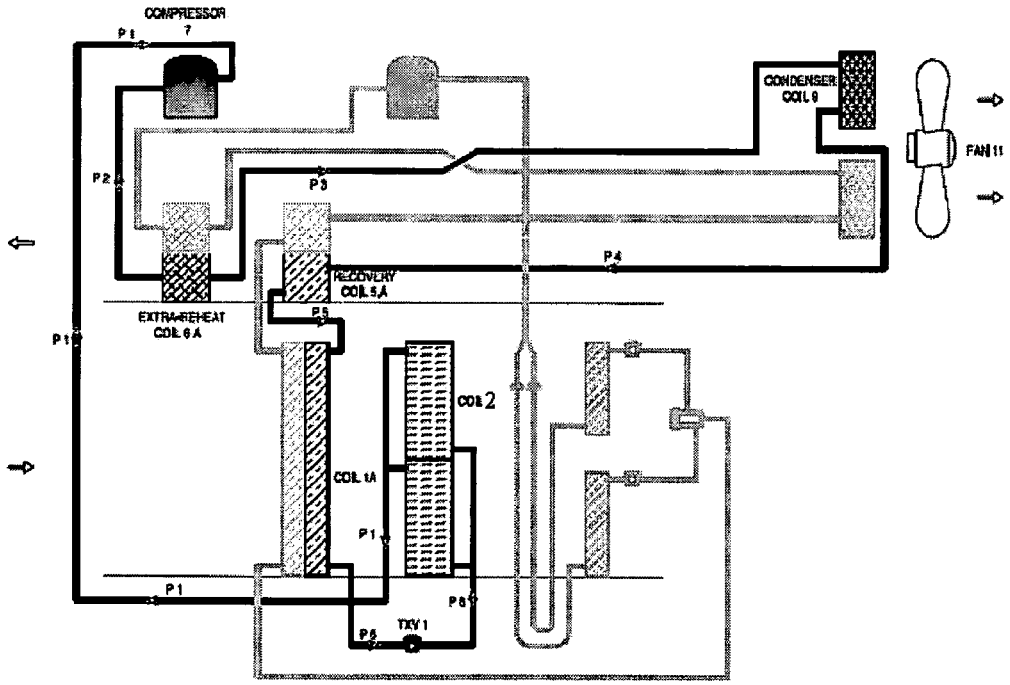
Figure 2B:
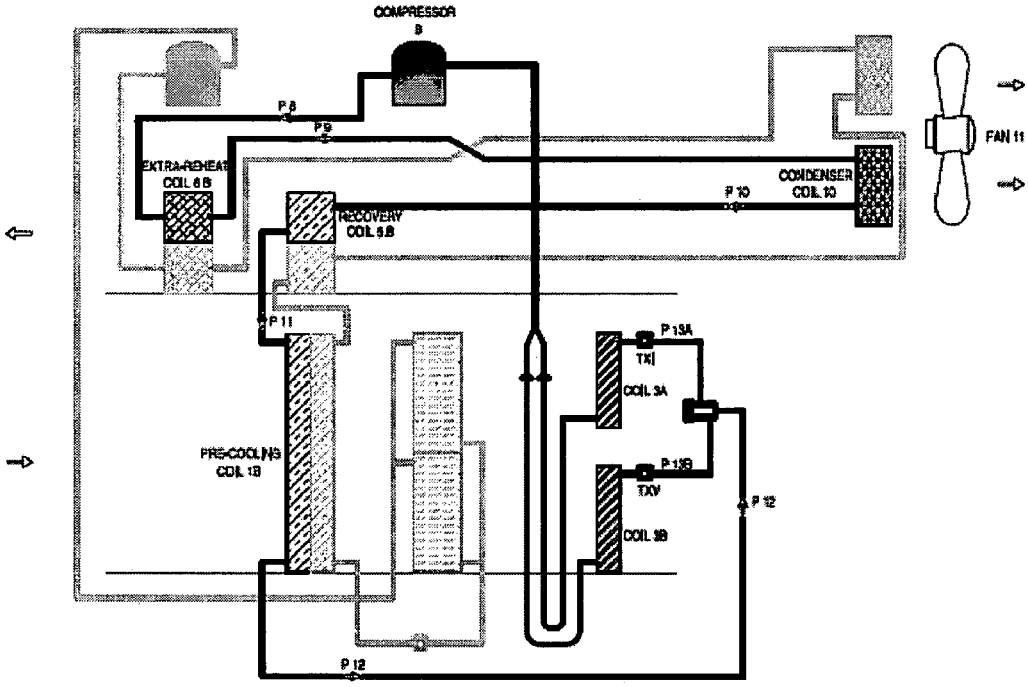
Figure 3:
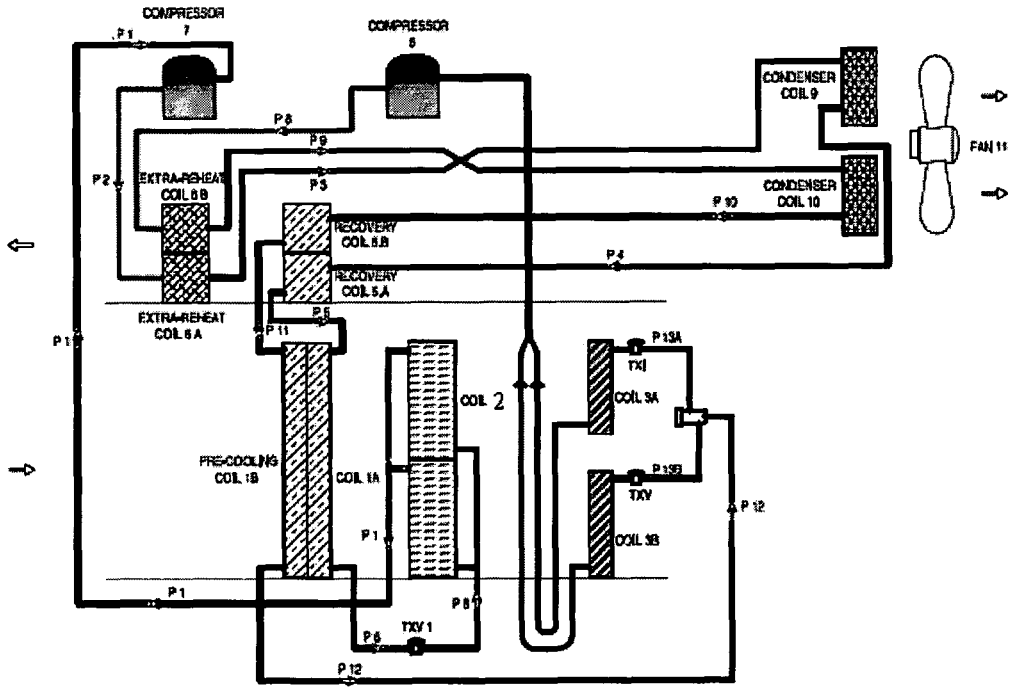
Figure 4:
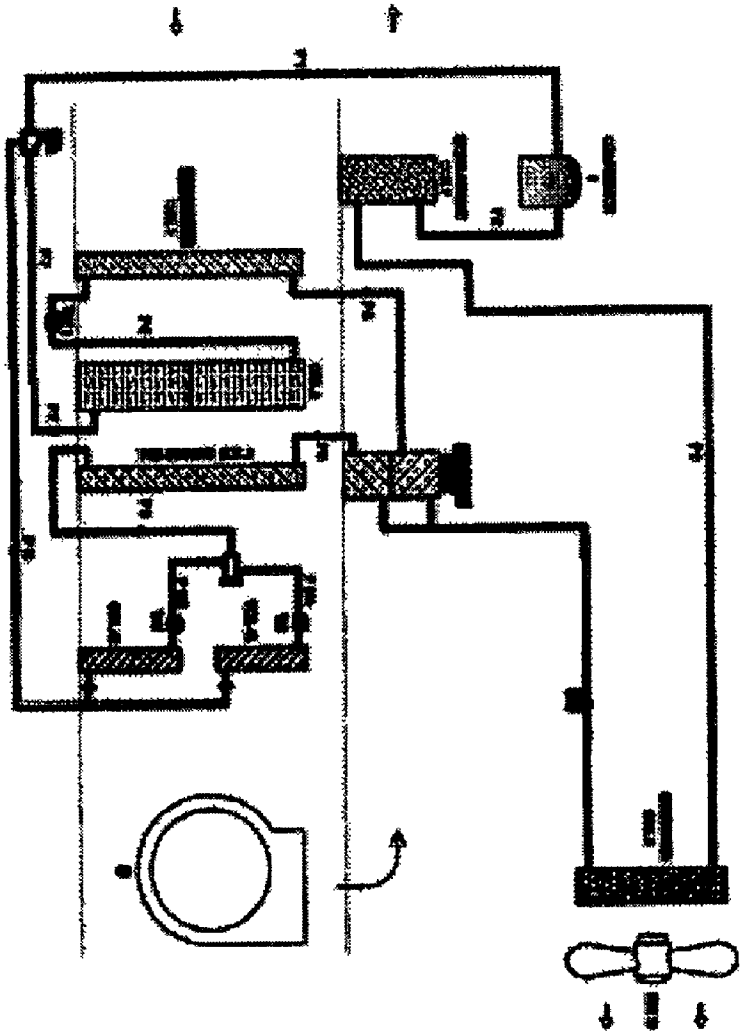

| | |
|---|---|
| FIG. 1 | Shows perspective view of an energy efficient frost free sub zero air conditioner in accordance to present invention. |
| FIG. 2A | Shows the interconnection of the first cooling system with the refrigeration circuit of an energy efficient frost free sub zero air conditioner in accordance to present invention. |
| FIG. 2B | Shows the interconnection of the second cooling system with the refrigeration circuit of an energy efficient frost free sub zero air conditioner in accordance to present invention. |
| FIG. 3 | Shows the detailed interconnection diagram (combination of FIG. 2A and 2B) of an energy efficient frost free sub zero air conditioner in accordance to present invention. |
| FIG. 4 | Shows perspective view of an energy efficient frost free sub zero air conditioner in accordance to present invention. |

DETAILED DESCRIPTION OF THE INVENTION

The above, and the other objects, features & advantages of invention will become apparent from following description read in conjunction with the accompanying drawings.

Referring to FIG. 1, an energy efficient frost free sub zero air conditioner in accordance to present invention comprises precooling coils (1A,1B), first stage cooling coil (2), second stage cooling coils (3A,3B), fan (4), compressor (7,8) having condenser coils (9,10) respectively, heat recovery coils (5A, 5B), reheat coils (6A,6B) and control circuit (12).

As shown in FIG. 1. Air enters and passes through the pre-cooling coils 1A & 1B. It then enters the first stage cooling coil 2. This coil cools the air to an intermediate temperature just enough above zero degree Celsius so that freezing of the refrigerant is avoided. This pre-cooled air then enters, two coils 3A and 3B that are fixed side by side, in the same plane, such that their combined dimensions equal that of coil 2. Thus one half of the air leaving coil 2 passes thorough coil 3A and the other half passes through coil 3B. These two streams are mixed and drawn into the inlet of a fan 4 that raises its pressure to a level sufficient to overcome the resistance of the system elements such as filters, coils, dampers, ductwork, grilles etc. and deliver the required air quantity into the conditioned area. The fan 4 pushes the air through the recovery coils 5A & 5B and then through the extra reheat coils 6A & 6B. The conditioned air then leaves the unit and enters the ductwork through a filter.

Now referring to FIGS. 1, 2A, 2B & 3, the refrigeration circuit interconnects each of two compressors 7 & 8, to its own condenser coil 9 or 10 and the said coils 1, 2, 3, 5 & 6. Both the condenser coils are cooled by a common fan 10. The manner of the interconnections is shown in FIGS. 2A, 2B & 3. FIGS. 2A and 2B show, separately, the circuit of each of the two compressors, while FIG. 3 gives a composite view of the entire circuit.

FIG. 2A shows the refrigeration circuit of the first stage compressor 7. The compressor draws in the refrigerant vapour from coil 2 via pipe P1, raises its pressure and passes it through the extra reheat coil 6A via pipe P2 and then to the condenser coil 9 via pipe P3. There the hot gas is condensed into liquid that travels to the recovery coil 5A via pipe P4, and enters the pre cooling coil 1A via pipe P5. Here it absorbs heat from the entering air and passes it on to the said recovery coil 5A. The liquid then leaves the coil 1A and enters the main cooling coil 2 of the first stage via pipe P6 through the expansion device "TXV"-1. This device reduces the pressure of the liquid flowing through the said coil 2A so that it turns into vapour by absorbing the heat of the air passing through it. The vapour goes back to the compressor 7 via pipe P1, thus completing the circuit.

In the second stage as shown in FIG. 3, the compressor 8 draws vapour from coils 3A & 3B, compresses it and sends it to extra reheat coil 6B via pipe P8 and then to condenser coil 10 via pipe P9. The liquid from coil 10 travels, in the same manner as stage 1, through recovery coil 5B and pre cooling coil 1B through pipes P10 & P11. It is then supplied, alternately, either to coil 3A or to coil 3B, but not to both at the same time. This is controlled by a three way electrically operated valve 13 by a signal from the control module 12. Pipe P12 connects the said coil 1B to valve 13. Two lines P13A and P13B connect the two output ports of valve 13 to coils 3A and 3B respectively through expansion devices TXV. Air passing through the coil that is fed with liquid refrigerant at the moment will turn it into vapour that will go to the compressor 8 via pipe P7. This completes the circuit. A non return valve in each of these pipes stops reverse flow in the non-working coil.

FIG. 4 illustrate the single compressor working similar to FIG. 3.

Now again referring back to FIG. 1. Coil 1A and 5A are connected internally such that when warm air enters coil 1A, the refrigerant in the coil will boil and its vapour will travel up to coil 5A. Here it will condense due to the cooling effect of the cold air coming from the cooling coils 3A and 3B. So coil 1A absorbs the heat from the incoming warm air and sends it to coil 5A, thus bypassing it away from the refrigeration coils. Thus the load on the refrigeration plant decreases by that amount and economy is achieved. Where two compressors are used, Coils 1B and 5B form a similar pair. Coils 6A and 6B provide heat from the hot gas of the compressors for reheating the air and save electricity.

Working of an Energy Efficient Air Conditioner of Present Invention:

When air is chilled to temperatures below zero degree Celsius, by refrigeration, the moisture that condenses will freeze and the ice so formed will block the flow of air through the cooling coil. This requires that a "Defrost cycle" must be started, whereby the ice is melted out, usually by application of heat. These cycles can be manual or automatic, but neither the flow nor the temperature of the air being cooled can be maintained at set value. This causes great inconvenience where steady flow and constant temperature are vital.

The present invention uses two cooling systems. The first cooling system with single cooling coil cools the air to a temperature just above zero deg. C., say X deg. C. so that the second stage gets a steady supply of cold air. The second stage has two coils, each being half the size of the first stage coil, thus taking half the air from it so that all the air from stage 1 passes through stage 2. In operation, only one coil of the second stage is active and chills the air going through it to say minus Y Deg. C. The other coil, being inactive, passes on the +X Deg. C. air coming from the first stage. In order to prevent the active coil from icing up, a control circuit diverts the refrigerant to the second coil within a period short enough to prevent any significant ice build up in that coil. This goes on so that the total air flow is a steady 50% mixture of air at X Deg. C. and minus Y deg. C. The detailed working is exemplified as follow:

The total air quantity produced by the said fan passes through the first stage cooling coil 1 and is then divided in two streams that pass through coils 3A and 3B. The first stage cools the air to a set point near zero degree C. say +4° C. Then the active coil 3A of the second stage will cool half the air coming from coil 2 of the first stage to a set point of −14° C. The total temperature drop due to coils 2 and 3A is 18° C. Since coil 3B is inactive, the air coming out of it will be at +4 Deg. C., as cooled by the first stage. Thus when the two streams mix at the outlet, the temperature will be always −5° C. A timer will flip active and inactive coils at a rate that is fast enough so that ice does not have time to form in the −14° C. coil in sufficient quantity to be able to impede the flow of air through it. When the coil is running in the inactive mode, whatever ice that had formed earlier will melt off due to the +4° C. air from stage 1 flowing through it. Thus a steady flow of air at the desired temperature of −5° C. will be always available, since the two coil sets will always have opposite set points so that the mixture is always at the desired temperature. It is like mixing hot & cold water in order to get precise temperature. This is achieved at sub-zero temperatures without using electric, hot water or hot gas defrosts cycle.

Advantages of the Frost Free Sub-Zero Air Conditioner of the Present Invention:

1. It is an energy efficient air conditioner that can provide a continuous supply of air at dew point that is several degrees Celsius below zero.
2. It avoids the use of electricity, hot water or other external energy source for defrosting and thereby saves a lot of energy.

INDUSTRIAL APPLICABILITY

A frost free sub-zero air conditioner of present invention can be used for both domestic as well as industrial applications.

The present invention is not limited to the above described embodiments, and various alterations, modifications, and/or alternative applications of the invention may be possible, if desired, without departing from the scope and spirit of the invention which can be read from the claims and the entire specification. The coil (2) of the first cooling system can also be split in two as 2A & 2B to match coils 3A & 3B, with two centrifugal/axial fans 4A & 4B, each feeding one section, and an axial fan for the condenser. There can be two or more such sections working in parallel, with the sub zero coils flipping in sequence, with each section being independent and having it own enclosure. It may be possible to use only one compressor and a single refrigeration circuit in air conditioner. All these possible alterations, modifications, and/or alternative applications of the invention are also intended to be within technical scope of the present invention.

I claim:

1. An energy efficient frost free sub zero air conditioner comprising:

a plurality of precooling coils for receiving the air to be conditioned;

at least one pair of cooling systems for receiving said air to be conditioned from said precooling coils, and providing a continuous supply of conditioned air at a dew point that is several degrees Celsius below zero, each of said pair of cooling systems comprising:

(i) a first cooling system comprising a first number of cooling coils associated therewith to cool air at a first temperature that is just above zero degree Celsius;

(ii) a second cooling system comprising a second number of cooling coils associated therewith, wherein said second number is greater than said first number, wherein said cooling coils of said second cooling system are placed side by side, in the same plane, such that their combined dimensions are equal to that of said cooling coils of said first cooling system, and wherein said second cooling system cools air at a second temperature that is below zero degrees Celsius;

at least one electric fan for delivering said conditioned air from said second cooling system into an area to be conditioned;

at least one refrigeration circuit comprising at least one compressor, a condenser coil, and a second electric fan for cooling said condenser coil;

a plurality of heat recovery coils to recover heat from said precooling coils;

a plurality of reheating coils for providing reheating of said conditioned air after it leaves said electric fan, to prevent initiation of a defrost cycle of the air conditioner;

a plurality of pipes for connecting said cooling coils of said first and second cooling systems, said condenser coils, said heat recovery coils, and said reheating coils;

a control circuit for controlling a flow of said refrigerant through said cooling coils of said second cooling system to prevent ice formation in said cooling coils of said second cooling system;

wherein said air at said first temperature exiting said first cooling system is provided in a proportion to each of said cooling coils of the second cooling system, and wherein said control circuit keeps a portion of the cooling coils of the second cooling in an active mode by allowing said flow of said refrigerant through said portion of said cooling coils of the second cooling system, while keeping a remainder of said cooling coils of the second cooling in an inactive mode by disallowing said flow of said refrigerant through said remainder of said cooling coils, so that the total air flow from the second cooling system is an approximately 50% mixture of air at said first temperature and air at said second temperature.

2. The air conditioner of claim 1, wherein the air conditioner comprises one pair of cooling systems.

3. The air conditioner of claim 1, wherein said first cooling system comprises one cooling coil, and said second cooling system comprises two cooling coils, each of said cooling coils of said second cooling system having a dimension half of said cooling coil of said first cooling system.

4. The air conditioner of claim 1, wherein the air conditioner comprises a plurality of pairs of cooling systems connected in parallel.

5. The air conditioner of any one of claims 1-4, wherein said first temperature is four degrees Celsius.

6. The air conditioner of claim 4, wherein said second temperature is minus fourteen degrees Celsius.

7. The air conditioner of any one of claims 1-4, wherein said coils are made of copper.

8. The air conditioner of any one of claims 1-4, wherein said refrigerant is in liquid form.

9. The air conditioner of any one of claims 1-4, wherein said refrigerant is in vapor form.

10. An air conditioning system, comprising:

a first refrigeration circuit, comprising:

a first compressor for compressing a first refrigerant;

a first reheat coil;

a first condensing coil;

a first recovery coil;

a first precooling coil; and a first stage cooling coil, wherein said first compressor, said first reheat coil, said first condensing coil, said first recovery coil, said first precooling coil, and said first stage cooling coil are in fluid communication, so that said first refrigerant passes therebetween, a second refrigeration circuit, comprising:

a second compressor for compressing a second refrigerant;

a second reheat coil;

a second condensing coil;

a second recovery coil;

a second precooling coil; and at least two second stage cooling coils, wherein said second compressor, said second reheat coil, said second condensing coil, said second recovery coil, said second precooling coil, and said at least two second stage cooling coils are in fluid communication, so that said second refrigerant passes therebetween, and a controller, wherein air to be conditioned passes, in order, through said first and second precooling coils, said first stage cooling coils, said at least two second stage cooling coils, said first and second recovery coils, and said first and second reheat coils, wherein a portion of said air passes through a first of said second stage cooling coils, and a portion of said air passes through a second of said second stage cooling coils, wherein said controller controls said at least two second stage cooling coils so that said first of said second stage cooling coils is active, and said second of said second stage cooling coils is inactive, wherein said first stage cooling coil cools said air to a temperature that is above zero degrees Celsius, and wherein said active second stage cooling coil cools said air to a temperature that is below zero degrees Celsius.

11. The air condition system of claim 10, wherein said portion of said air passing through said first of said second stage cooling coils is substantially equal to said portion passing through said second of said second stage cooling coils.

12. The air conditioning system of claim 10, further comprising a fan for receiving said air from said at least two second stage cooling coils and passing it though said first and second recovery coils.

13. The air conditioning system of claim 10, wherein said first precooling coil and said first recovery coil are in direct fluid communication, so that when said first refrigerant evaporates in said first precooling coil, it passes into said first recovery coil, and heats said air passing therethrough.

14. The air conditioning system of claim 10, wherein said second precooling coil and said second recovery coil are in direct fluid communication, so that when said second refrigerant evaporates in said second precooling coil, it passes into said second recovery coil, and heats said air passing therethrough.

15. The air conditioning system of claim 10, wherein a combined dimension of said at least two second stage cooling coils is equal to that of said first stage cooling coil.

16. The air conditioning system of claim 10, wherein said first refrigeration circuit, said second refrigeration circuit, and said controller are within a single enclosure.

* * * * *